US009665030B2

(12) United States Patent
Kato et al.

(10) Patent No.: US 9,665,030 B2
(45) Date of Patent: May 30, 2017

(54) IMAGE FORMING APPARATUS WITH A PROXIMITY CHARGER

(71) Applicant: KONICA MINOLTA, INC., Chiyoda-ku, Tokyo (JP)

(72) Inventors: Tomohiro Kato, Okazaki (JP); Kazuki Kobori, Toyokawa (JP); Hirohisa Shirai, Toyokawa (JP); Hisashi Murata, Toyohashi (JP); Masato Kimura, Toyoake (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/050,023

(22) Filed: Feb. 22, 2016

(65) Prior Publication Data

US 2016/0252839 A1 Sep. 1, 2016

(30) Foreign Application Priority Data

Feb. 26, 2015 (JP) ..... 2015-036272

(51) Int. Cl.
*G03G 15/02* (2006.01)
*G03G 21/20* (2006.01)

(52) U.S. Cl.
CPC ..... *G03G 15/0266* (2013.01); *G03G 21/20* (2013.01); *G03G 2215/00772* (2013.01); *G03G 2215/00776* (2013.01)

(58) Field of Classification Search
CPC . G03G 15/0266; G03G 21/0094; G03G 21/20
(Continued)

(56) References Cited

U.S. PATENT DOCUMENTS 6,532,347 B2 * 3/2003 Watanabe ..... G03G 15/0266 361/225
7,522,853 B2 4/2009 Uchitani
(Continued)

FOREIGN PATENT DOCUMENTS

JP 2005003728 A 1/2005
JP 2006201487 A * 8/2006
(Continued)

OTHER PUBLICATIONS

Japanese Office Action (and English translation thereof) dated Jan. 31, 2017 issued in counterpart Japanese Application No. 2015-036272.

*Primary Examiner* — Robert Beatty
(74) *Attorney, Agent, or Firm* — Holtz, Holtz & Volek PC

(57) ABSTRACT

An image forming apparatus has: an image supporting member, a charger, a power source unit, an amperometric detector, and a processor. The power source unit applies a plurality of charging voltages, which includes alternating voltages respectively, to the charger sequentially while no print medium is fed. The alternating voltages have different peak-to-peak voltages for a forward discharge range and different peak-to-peak voltages for a reverse discharge range, respectively. The amperometric detector detects values of alternating current flowing in the charger during application of the charging voltages. The processor derives characteristic lines of alternating current value with respect to alternating voltage for the forward discharge range and for the reverse discharge range, respectively, from the values detected by the amperometric detector. The processor derives a peak-to-peak voltage to be used in a process in a different way depending on a difference in slope between the characteristic lines.

7 Claims, 8 Drawing Sheets

(58) Field of Classification Search
USPC ..... 399/43, 44, 50
See application file for complete search history.

(56) References Cited

U.S. PATENT DOCUMENTS

| | | | | |
|---|---|---|---|---|
| 7,684,719 | B2 * | 3/2010 | Kitajima | G03G 15/0266 399/168 |
| 9,134,645 | B2 * | 9/2015 | Yoshida | G03G 15/0283 |
| 2007/0091657 | A1 | 4/2007 | Uchitani | |
| 2016/0252838 | A1 * | 9/2016 | Kato | G03G 21/20 |
| 2016/0252840 | A1 * | 9/2016 | Murata | G03G 15/0266 |

FOREIGN PATENT DOCUMENTS

| | | | |
|---|---|---|---|
| JP | 2007114386 | A | 5/2007 |
| JP | 2009086108 | A | 4/2009 |

* cited by examiner

IMAGE FORMING APPARATUS WITH A PROXIMITY CHARGER

The present invention claims benefit of priority to Japanese Patent Application No. 2015-036272 filed Feb. 26, 2015, the content of which is incorporated herein by reference.

BACKGROUND OF THE INVENTION

1. Field of the Invention

The present invention relates to an image forming apparatus comprising a proximity charger to be impressed with a superimposed voltage of a DC voltage and an AC voltage.

2. Description of Related Art

Recently, for charging in an image forming apparatus, a proximity charging method is mainly adopted. In the proximity charging method, for example, a roller-type charger is provided in proximity to the surface of a photoreceptor drum so as to be in contact or out of contact with the surface of the photoreceptor drum. A superimposed voltage of a DC voltage and an AC voltage is applied to the charger so that the charger can charge the surface of the photoreceptor drum uniformly.

It is known that the charged potential Vs of the surface of the photoreceptor drum and the peak-to-peak voltage Vpp of the AC voltage Vac have a relationship as illustrated in FIG. 8. While the peak-to-peak voltage Vpp is within a range from a charging start voltage Vth to a voltage 2×Vth, the charged potential Vs is substantially proportional to the AC voltage Vac. Here, the charging start voltage value Vth is a voltage value that permits the charger to start charging the photoreceptor drum, and the voltage value Vth is defined by the DC voltage Vdc. The charging start voltage Vth is determined depending on the characteristics of the photoreceptor drum and other factors. In the case of FIG. 8, the voltage value Vth is 800V, and the voltage value 2×Vth is 1600V.

After the peak-to-peak voltage Vpp becomes above the value 2×Vth, the charged potential Vs of the surface of the photoreceptor drum is saturated and substantially kept constant at Vs0. Therefore, in order to charge the surface of the photoreceptor drum to have a uniform charged potential Vs, it is necessary to apply a superimposed voltage obtained by superimposing an AC voltage Vac having a peak-to-peak voltage Vpp greater than 2×Vth on a DC voltage Vdc to the charger. In this regard, the charged potential Vs0 depends on the DC voltage Vdc of the superimposed voltage.

Meanwhile, in an image forming apparatus, the amount of discharge from a charger is required to be constant regardless of changes in environmental conditions, variations in the resistance of the charger due to manufacturing errors, etc. so as to charge a photoreceptor drum uniformly without causing deterioration of the photoreceptor drum, poor-quality image formation, etc. For this purpose, conventionally, an image forming apparatus comprises a measuring device that measures the alternating current flowing in the charger via the photoreceptor drum, and a controller.

The measuring device measures values of the alternating current while no sheets are fed in the image forming apparatus. Specifically, the measuring device measures values of the alternating current flowing in the charger when alternating voltages Vac having different peak-to-peak values Vpp respectively, all of which are less than 2×Vth, are applied to the charger sequentially. In a similar way, the measuring device measures the values of alternating current flowing in the charger when alternating voltages Vac having different peak-to-peak voltages Vpp respectively, all of which are equal to or greater than 2×Vth, are applied to the charger. In this specification, a range in which the peak-to-peak voltage Vpp is less than 2×Vth is referred to as a forward discharge range, in which charge transfers only from the charger to the photoreceptor drum (that is, mono-directional charge transfer occurs), and a range in which the peak-to-peak voltage Vpp is equal to or greater than 2×Vth is referred to as a reverse discharge range, in which charge transfers from the charger to the photoreceptor drum and from the photoreceptor drum to the charger alternately (that is, bi-directional charge transfer between the charger and the photoreceptor drum occurs).

From the values of the alternating current collected by the measuring device, the controller determines a peak-to-peak voltage Vppi of the alternating voltage Vaci to be used as a component of the charging voltage in a printing process. In this specification, such a control process is referred to as a first charging voltage determination process.

A specific example of the first charging voltage determination process will hereinafter be described with reference to FIG. 9. The controller obtains values Iac1-Iac3 of the alternating current flowing in the charger when AC voltages Vac1-Vac3 are applied to the charger in the forward discharge range, and from the alternating current values Iac1-Iac3, the controller derives a characteristic line L1 indicating alternating current values with respect to the applied AC voltage in the forward discharge range by direct approximation. In a similar way, the controller derives a characteristic line L2 indicating alternating current values with respect to the applied AC voltage in the reverse discharge range. The controller determines the point of intersection between the characteristic lines L1 and L2 as the alternating voltage Vaci to be used as a component of a superimposed charging voltage in a printing process.

When the alternating current value Iac is determined by the first charging voltage determination process, non-uniformity of the film thickness of the photoreceptor drum is taken into consideration in some cases. More specifically, while the photoreceptor drum is rotated once, the controller obtains the alternating current values Iac at a predetermined number of places different from each other in the circumferential direction. The controller determines the average of the measured alternating current values Iac as the alternating current value Iac achieved by application of the alternating voltage Vac to the charger.

There are other ways of deriving a peak-to-peak voltage Vpp (see, for example, Japanese Patent Laid-Open Publication No. 2009-086108).

Meanwhile, a roller-type charger is likely to cause more abrasion of the photoreceptor film, as compared to a corona-discharge-type charger. In a recent image forming apparatus, also, in order to remove discharge products and the like adhering to the photoreceptor film, the photoreceptor film is scraped as needed. In a case in which a roller-type charger is used in such an image forming apparatus, it is important to use a photoreceptor having a thick photoreceptor film and to minimize the amount of abrasion per a predetermined number of rotations of the photoreceptor.

In the first charging voltage determination process, an AC voltage Vaci that is the point of intersection between the characteristic lines L1 and L2 is derived from the difference in slope between the characteristic lines L1 and L2. However, the inventors found out by an experiment that there are cases in which the AC voltage Vaci determined by the first charging voltage determination process is not proper, depending on the photoreceptor film thickness and/or the ambient temperature. For example, when the ambient temperature is low or when the photoreceptor film is thick, the difference in slope between the characteristic lines L1 and L2 is small, and the AC voltage Vaci derived from the slope difference is likely to shift to a lower side. If a charging voltage including an AC voltage Vaci lower than a proper value is used in a printing process or the like, toner fogging may occur.

SUMMARY OF THE INVENTION

An object of the present invention is to provide an image forming apparatus that is capable of deriving a proper peak-to-peak voltage of an alternating current regardless of the ambient temperature and the photoreceptor film thickness.

According to an embodiment of the present invention, an image forming apparatus is capable of forming an image on a print medium while feeding the print medium, and the image forming apparatus comprises: an image supporting member; a charger provided in proximity to the image supporting member; a power source unit configured to apply a plurality of charging voltages to the charger sequentially while no print medium is fed, the plurality of alternating voltages having different peak-to-peak voltages for a forward discharge range, in which charge transfer from the charger to the image supporting member occurs, and different peak-to-peak voltages for a reverse discharge range, in which charge transfer from the charger to the image supporting member occurs, respectively; an amperometric detector configured to detect values of alternating current flowing in the charger during application of the plurality of charging voltages; and a processor configured to derive a characteristic line of alternating current value with respect to alternating voltage for the forward discharge range and a characteristic line of alternating current value with respect to alternating voltage for the reverse discharge range from the values of alternating current detected by the amperometric detector, wherein the processor derives a peak-to-peak voltage to be used in a process in a different way depending on a difference in slope between the characteristic line for the forward discharge range and the characteristic line for the reverse discharge range.

DETAILED DESCRIPTION OF THE DRAWINGS

Some preferred embodiments of the present invention will hereinafter be described with reference to the drawings.

1. Definitions

In some of the drawings, x-direction, y-direction and z-direction that are perpendicular to one another are indicated. The x-direction and the z-direction indicate the right-left direction and the up-down direction of an image forming apparatus 1. The y-direction indicates the front-rear direction of the image forming apparatus 1.

2. General Structure of Image Forming Apparatus and Printing Process

Figure 1:
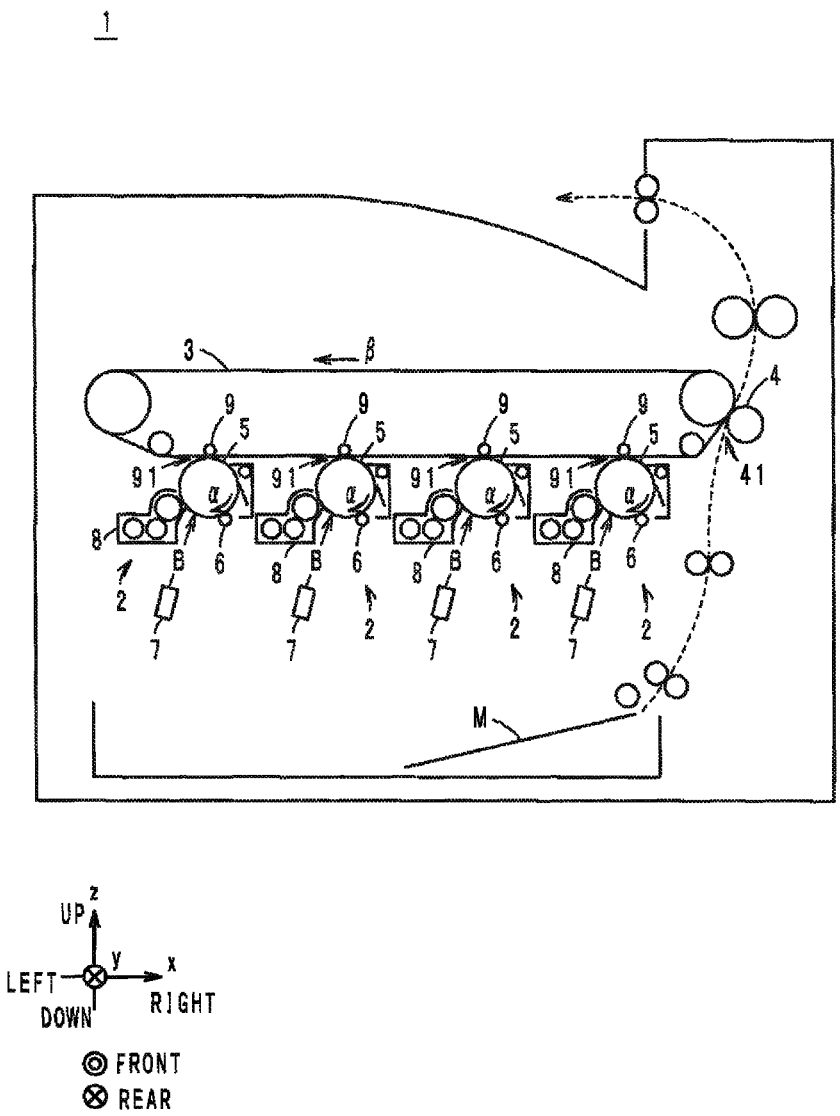
FIG. 1 is a schematic view of an image forming apparatus.
Figure 2:
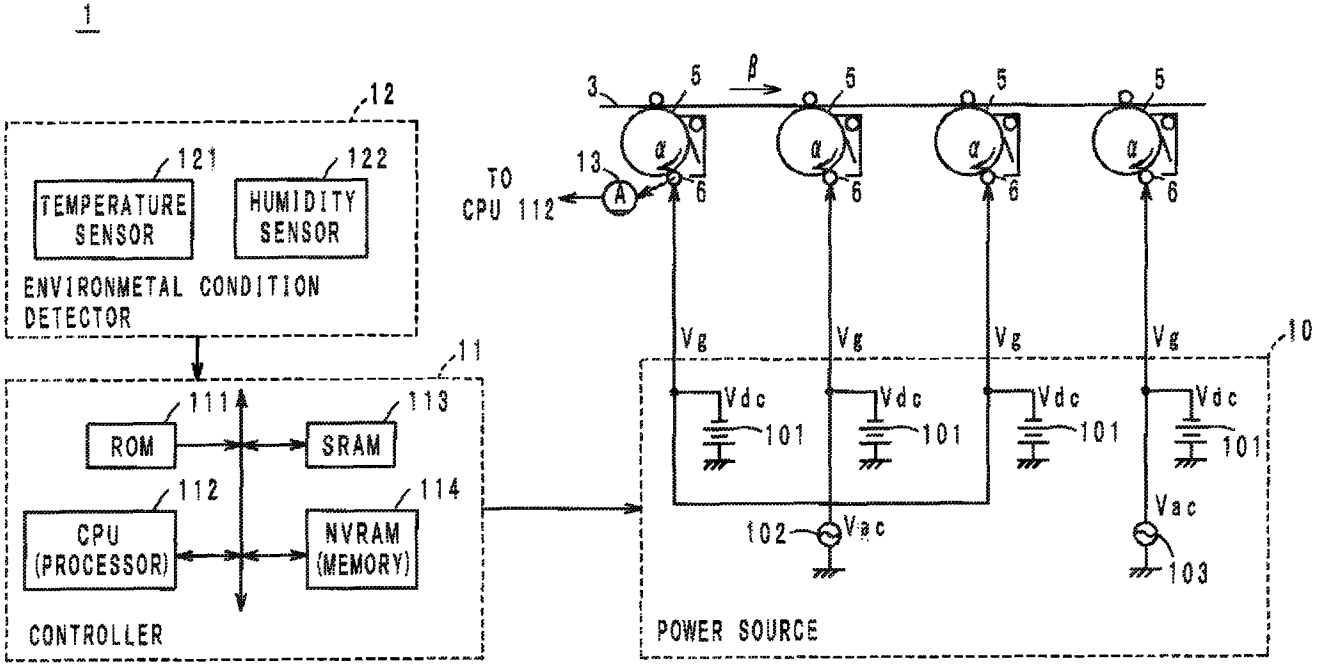
FIG. 2 is a configuration diagram of a main part of the image forming apparatus.

The image forming apparatus 1 illustrated in FIGS. 1 and 2 is, for example, a copying machine, a printer, a facsimile or a multifunction peripheral capable of functioning as these machines. The image forming apparatus 1 prints an image (typically, a full-color image or a monochromatic image) on a print medium (for example, a sheet of paper or an OHP sheet) M by an electrophotographic tandem method. For this purpose, the image forming apparatus 1 comprises image forming units 2 respectively for yellow (Y), magenta (M), cyan (C) and black (K), an intermediate transfer belt 3, a second transfer roller 4, a power source 10, a controller 11, an environmental condition detector 12, and at least one amperometric detector 13.

The image forming units 2 for the four colors are arranged side by side, for example, in the right-left direction, and each of the image forming units 2 includes a photoreceptor drum 5. The photoreceptor drum 5 is, for example, in the shape of a cylinder extending in the front-rear direction, and rotates on its own axis, for example, in the direction indicated by arrow α.

Figure 3:
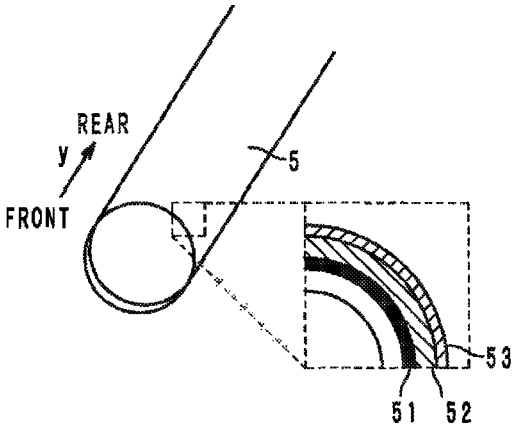
FIG. 3 is a view of a photoreceptor drum illustrated in FIG. 1, indicating a detailed structure thereof.

As illustrated in FIG. 3, the photoreceptor drum 5 is preferably an organic photoreceptor having a charge generating layer (which will hereinafter be referred to as CGL) 51, a charge transfer layer (which will hereinafter be referred to as CTL) 52 and a protective layer (which will hereinafter be referred to as OCL) 53 stacked in this order on an aluminum base extending in the front-rear direction. The OCL 53 is not indispensable to the photoreceptor drum 5.

Here, the amount of abrasion (μm) of the photoreceptor drum 5 every after 100000 rotations is defined as an index a indicating the abrasiveness of the surface of the photoreceptor drum 5. Table 1 below indicates the values a of various photoreceptor drums. For comparison, Table 1 also indicates the value a of an amorphous silicon (a-Si) photoreceptor. As mentioned above, in some cases, for removal of discharge products adhering to the OCL 53 or any other photoreceptor film, the OCL 53 or the like is scraped. According to this embodiment, the value a of the photoreceptor drum 5 is preferably greater than 0.5 so as to keep the amount of abrasion at a proper level.

TABLE 1

α of Various Photoreceptors

| | a-Si Photoreceptor | With OCL 53 | Without OCL 53 |
|---|---|---|---|
| α | 0.5 | 1.2 | 3.0 |

With reference to FIGS. 1 and 2 again, around each photoreceptor drum 5, at least a charger 6, a developing device 8 and a first transfer roller 9 are arranged in this order from upstream to downstream in the rotating direction α of the photoreceptor drum 5.

The charger 6 is typically a charging roller extending in the front-rear direction, and the charging roller is arranged in proximity to the corresponding photoreceptor drum 5 so as to be either in contact with or out of contact with the peripheral surface of the photoreceptor drum 5. The charger 6 is supplied with a voltage Vg by the power source 10, and electrifies the peripheral surface of the corresponding photoreceptor drum 5 uniformly while the photoreceptor drum 5 is rotating.

The power source 10 includes DC power circuits 101 for the respective colors, an AC power circuit 102 shared for two or more colors (for example, for the colors Y, M and C) and an AC power circuit 103 used for the other color(s) (for example, for the color K).

Each of the DC power circuits 101 outputs a predetermined DC voltage Vdc under control of the controller 11. Since the DC power circuits 101 are provided individually for the respective colors, it is possible to adjust the DC voltages for the respective colors separately. This embodiment, however, does not deal with differentiating the DC voltages for the respective colors from each other. Therefore, in the following paragraphs, for the convenience sake, all of the DC voltages Vdc for the colors will be described as having the same value.

Each of the AC power circuits 102 and 103 is, for example, an AC transformer, and outputs an AC voltage Vac having a variable peak-to-peak voltage Vpp under control of the controller 11. In the following paragraphs, the AC voltages Vac output from the AC power circuits 102 and 103 will be described as having the same value for the same reason as the DC voltages Vdc.

The output terminal of the AC power circuit 102 is connected to the respective output terminals of the DC power circuits 101 for the colors Y, M and C. Then, the alternating voltage Vac is superimposed on the DC voltages Vdc, and charging voltages Vg are generated. The charging voltages Vg are applied to the respective chargers 6 for the colors Y, M and C. In a similar way, the output terminal of the AC power circuit 103 is connected to the output terminal of the DC power circuit 101 for the color K, and a charging voltage Vg is generated. The charging voltage Vg is applied to the charger 6 for the color K.

Under each of the photoreceptor drums 5, an exposure device 7 is provided. The exposure device 7 irradiates the photoreceptor drum 5 with a light beam B in accordance with image data at an exposure area immediately downstream from a charging area where the photoreceptor drum 5 is electrified. Accordingly, an electrostatic latent image for the corresponding color is formed.

The developing device 8 supplies the corresponding photoreceptor drum 5 with a developer in the corresponding color at a developing area immediately downstream from the exposure area. Accordingly, a toner image in the corresponding color is formed.

The intermediate transfer belt 3 is stretched around the peripheral surfaces of at least two rollers arranged in the right-left direction, for example. The intermediate transfer belt 3 is rotated, for example, in a direction indicated by arrow β. The peripheral surface of the intermediate transfer belt 3 is, for example, in contact with the upper ends of the photoreceptor drums 5.

The first transfer roller 9 is provided to face the corresponding photoreceptor drum 5 across the intermediate transfer belt 3. The first transfer roller 6 presses the intermediate transfer belt 3 from above such that a first transfer nip 91 is formed between the corresponding photoreceptor drum 5 and the intermediate transfer belt 3. During a printing process, a first transfer bias voltage is applied to the first transfer roller 9, and accordingly, the toner image on the corresponding photoreceptor drum 5 is transferred to the intermediate transfer belt 3 at the corresponding first transfer nip 91 while the intermediate transfer belt 3 is rotating.

The second transfer roller 4 is capable of rotating on its axis. During a printing process, a second transfer bias voltage is applied to the second transfer roller 4. The second transfer roller 4 is located, for example, near the right side of the intermediate transfer belt 3. The second transfer roller 4 presses the outer peripheral surface of the intermediate transfer belt 3 such that a second transfer nip 41 is formed at a contact portion between the second transfer roller 4 and the intermediate transfer belt 3. During the printing process, a print medium M is fed to the second transfer nip 41.

While the print medium M is passing through the second transfer nip 41, the second transfer bias voltage is applied to the second transfer roller 4, and therefore, the toner image carried on the intermediate transfer belt 3 is transferred to the print medium M. After passing through the second transfer nip 41, the print medium M passes through a fixing device of a conventional type and is ejected on a tray as a printed matter.

The controller 11 comprises a ROM 111, a CPU 112 (an example of a processor), an SRAM 113 and an NVRAM 114 (an example of a memory). The CPU 112 carries out various processes by following a control program preliminarily stored in the ROM 111 with using the SRAM 113 as a workspace. This embodiment deals with especially the following four processes: 1) a printing process of printing an image on a print medium M; 2) an image stabilization process of controlling the toner density in accordance with a density of a predetermined pattern image so as to achieve a target value; 3) a forced toner resupply process of resupplying toner forcedly to a developing device; and 4) a TCR adjustment process of controlling the ratio between toner and carrier to achieve a target value. During any one of the four processes, the photoreceptor drums 5 must be electrified, and therefore, the charging voltages Vg are applied to the chargers 6.

Further, the CPU 112 carries out a charging voltage determination process, which will be described later, so as to determine a peak-to-peak voltage Vpp, which is to be used for the four processes above and is to be a reference of an AC voltage Vac to be used as a component of each charging voltage Vg. The peak-to-peak voltage Vpp determined as a reference will hereinafter be referred to as a reference peak-to-peak voltage Vpp0. Additionally, in order to determine a peak-to-peak voltage Vpp of an AC voltage Vac actually applied during the four processes, the CPU 112 stores the total number of rotations of each of the photoreceptor drums 5 as an example of usage conditions Irot in the NVRAM 114 (see Table 2 below). The peak-to-peak voltage Vpp of the actually applied voltage Vac will hereinafter be referred to as an actual peak-to-peak voltage Vpp1. Note that the reference peak-to-peak voltage Vpp0 is different from the actual peak-to-peak voltage Vpp1 in this embodiment, as will be described later.

TABLE 2

| Information on Usage Condition Irot | |
|---|---|
| Color | Total Number of Rotations |
| Y | 200,000 |
| M | 200,000 |
| C | 200,000 |
| K | 400,000 |

Moreover, the CPU 112 stores a reference peak-to-peak voltage Vpp0 and a corrected peak-to-peak voltage Vpp0' that were derived at the previous first charging voltage determination process in the NVRAM 114. The CPU 112 stores the temperature St inside the image forming apparatus 1 at the previous first charging voltage determination process as a previous inside temperature St'.

TABLE 3

| Contents of NVRAM 114 | |
|---|---|
| At previous charging voltage determination process | Reference peak-to-peak voltage Vpp0 |

The environmental condition detector 12 includes a temperature sensor 121 and a humidity sensor 122. The temperature sensor 121 detects the temperature inside the image forming apparatus 1 (inside temperature St) and outputs the detection result to the CPU 112. The humidity sensor 122 detects the relative humidity inside the image forming apparatus 1 (inside humidity Sh) and outputs the detection result to the CPU 112.

The amperometric detector 13 detects the value of the alternating current Iac flowing in each of the chargers 6, for example, flowing in the charger 6 for yellow when the charging voltage Vg is applied to the charger 6, and outputs the detection result to the CPU 112.

3. Action of the Image Forming Apparatus

Figure 4:
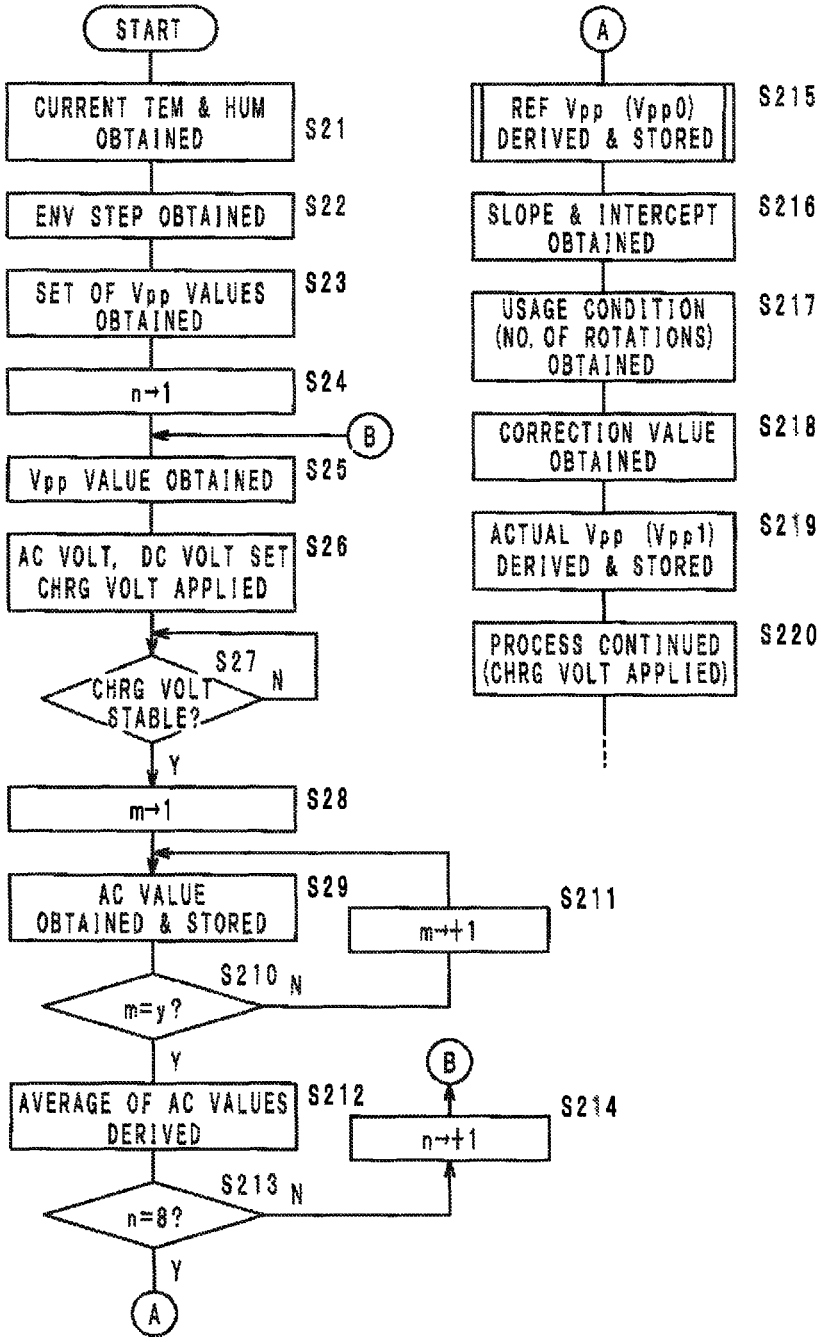
FIG. 4 is a flowchart indicating a process carried out by a CPU for charging voltage determination.

Next, with reference to FIGS. 4-7, the action of the image forming apparatus 1 is described. Referring to FIG. 4, the operation of the CPU 112 to determine the charging voltage to be used in any one of the four processes above is described. First, at S21, the CPU 112 obtains the current inside temperature St and the current inside humidity Sh from the environmental detector 12 with no print medium M fed in the image forming apparatus 1.

At S22, the CPU 112 selects an environment step corresponding to the inside temperature St and the inside humidity Sh obtained at S21 from an environmental step table Si preliminarily stored in the ROM 111 or the NVRAM 114. As Table 4 below indicates, the table T1 indicates an environment step, which is an index of the absolute humidity, for each combination of inside temperature and inside humidity. In this embodiment, there are 16 environment steps. The environment steps 1-3 mean a low-temperature and low-humidity state (LL state), and the environment steps 4-7 mean a normal-temperature and normal-humidity state (NN state). The environment steps 8-12 mean a little high-temperature and high-humidity state, and the environment steps 13-16 mean a high-temperature and high-humidity state (HH state).

TABLE 4

| Environment Step Table T1 | | | | | | | | |
|---|---|---|---|---|---|---|---|---|
| | | Inside Temperature (° C.) | | | | | | |
| | | <15 | <20 | <24 | <28 | <32 | <44 | 44≥ |
| Inside Humidity (%) | <18 | 1 | 1 | 1 | 2 | 2 | 2 | 2 |
| | <32 | 2 | 2 | 2 | 2 | 3 | 4 | 6 |
| | <55 | 3 | 5 | 5 | 7 | 7 | 8 | 9 |
| | <65 | 4 | 5 | 7 | 7 | 8 | 9 | 10 |
| | <75 | 6 | 6 | 7 | 8 | 9 | 10 | 11 |
| | <85 | 8 | 8 | 9 | 9 | 11 | 12 | 14 |
| | 85≥ | 10 | 11 | 12 | 13 | 14 | 15 | 16 |

Next, at S23, the CPU 112 selects a set of peak-to-peak voltages Vpp in accordance with the environment step obtained at step S22 from a peak-to-peak voltage table T2 preliminarily stored in the NVRAM 114 or the like. As Table 5 below indicates, the table T2 indicates several sets of eight peak-to-peak voltages Vpp. In each of the sets, four of the eight peak-to-peak voltages Vpp are for the forward discharge range, and the other four values Vpp are for the reverse discharge range. For example, for the environment steps 1-3, a set A of peak-to-peak voltages Vpp is selected, and the set A includes 600V, 700V, 800V and 900V for the forward discharge range and 1850V, 1950V, 2050V and 2150V for the reverse discharge range. As indicated in Table 5, a set B of peak-to-peak voltages Vpp is assigned to the environment steps 4-7. A set C of peak-to-peak voltages Vpp is assigned to the environment steps 8-12, and a set D of peak-to-peak voltages Vpp is assigned to the environment steps 13-16.

TABLE 5

| Peak-to-peak Voltage Table T2 | | | | | |
|---|---|---|---|---|---|
| | | Environment Step | | | |
| | n | 1-3 (Set A) | 4-7 (Set B) | 8-12 (Set C) | 13-16 (Set D) |
| Set of peak-to-peak voltages | 1 | 600 | 600 | 600 | 600 |
| | 2 | 700 | 700 | 700 | 700 |
| | 3 | 800 | 800 | 800 | 800 |
| | 4 | 900 | 900 | 900 | 900 |
| | 5 | 1850 | 1800 | 1750 | 1700 |
| | 6 | 1950 | 1900 | 1850 | 1800 |
| | 7 | 2050 | 2000 | 1950 | 1900 |
| | 8 | 2150 | 2100 | 2050 | 2000 |

Next, the CPU 112 resets the first counter, that is, sets the value n of the first counter to 1 at S24, and then, the CPU 112 picks up a peak-to-peak voltage Vpp from the selected set according to the current value n of the first counter at S25.

At S26, the CPU 112 sets the peak-to-peak voltages Vpp of AC voltages Vac to be output from the AC power circuits 102 and 103 to the value selected at S25, and the CPU 112 also sets the DC voltages Vdc to be output from the respective DC power circuits 101 to a predetermined value.

Consequently, charging voltages Vg are applied to the chargers 6 from the power source 10. When the AC voltages Vac output from the AC power circuits 102 and 103 become stable (YES at S27), the CPU 112 resets a second counter, that is, sets the value m of the second counter to 1 at S28. Next, at S29, the CPU 112 obtains the AC value Iac from the amperometric detector 13 and stores the value temporarily in the SRAM 113. Next, at S210, the CPU 112 judges whether or not the value m of the second counter is a number y. The number y is a natural number indicating the number of samples taken during one rotation of each of the photoreceptor drums 5. If the CPU 112 makes a negative judgement at step S210, the CPU 112 increments the second counter value m by one at S211 and executes the step S29.

During the process from S28 to S211, AC values Iac measured at y different places with respect to the circumferential direction during one rotation of each photoreceptor drum 5 are stored in the SRAM 113. When the CPU 112 makes an affirmative judgement at S210, the average of the y AC values Iac is derived. Next, at S213, the CPU 112 judges whether or not the first counter value n is 8 so as to judge whether or not the process S25 to S212 has been carried out with respect to all of the peak-to-peak voltages Vpp included in the set selected at S23. If the CPU makes a negative judgement at S213, the CPU 112 increments the first counter value n by one at S214 and executes the step S25.

While the CPU 112 carries out the process from S25 to S214, eight AC values Iac that are achieved by application of charging voltages Vg, which include alternating voltages Vac having different peak-to-peak voltages (four peak-to-peak voltages for the forward discharge range and four peak-to-peak voltages for the reverse discharge range) to each of the chargers 6 sequentially are obtained. The CPU 112 stores eight sets of a peak-to-peak voltage Vpp used at S26 and an AC value (average) Iac obtained at S212 in the SRAM 113. In the following paragraphs, the sets of a peak-to-peak voltage Vpp and an AC value Iac are collectively referred to as (Vpp, Iac). Also, the sets corresponding to n=1-8 are individually referred to as (Vppj, Iacj), in which j is a natural number from 1 to 8.

At S215, the CPU 112 carries out the first charging voltage determination process in accordance with (Vpp, Iac) in the SRAM 113 to derive a reference peak-to-peak voltage Vpp0 to be used in various processes, and the CPU 112 stores the reference peak-to-peak voltage Vpp0 in the NVRAM 114.

Figure 5:
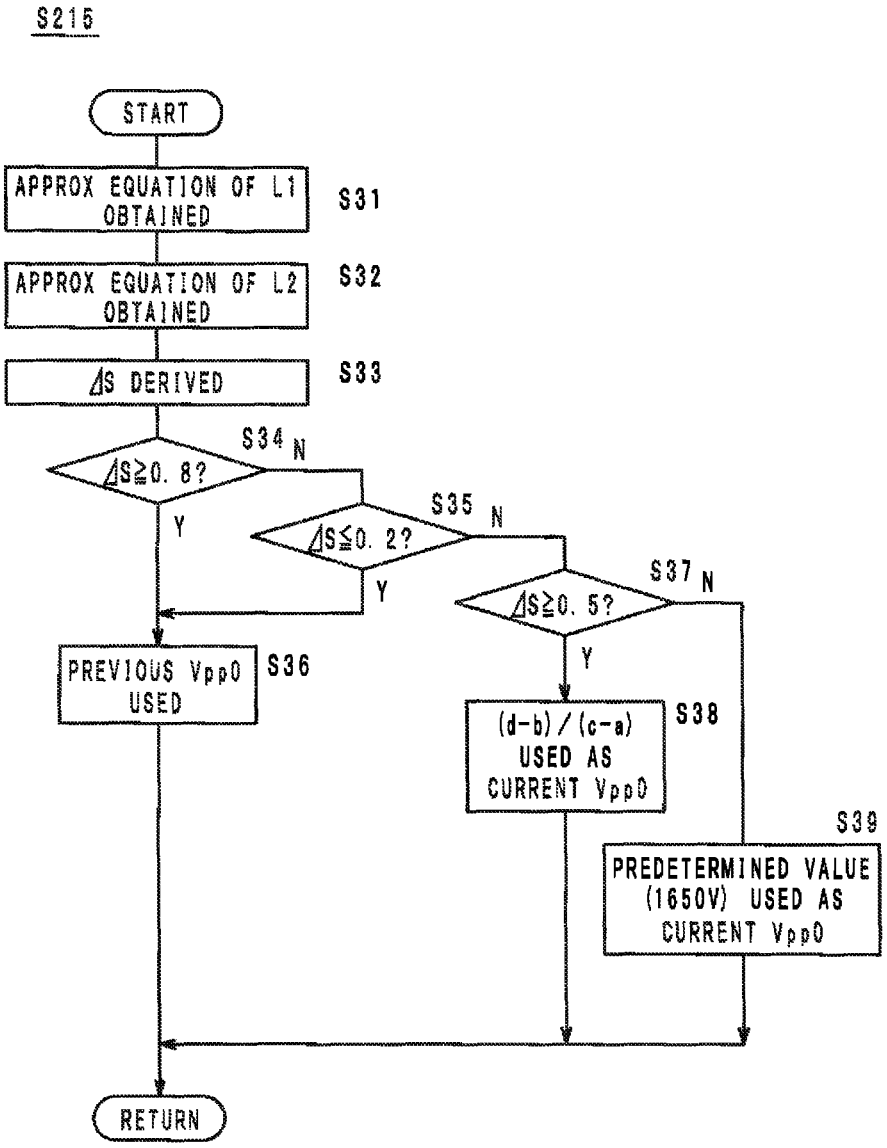
FIG. 5 is a detailed flowchart indicating a process carried out at S215 in FIG. 4.
Figure 6:
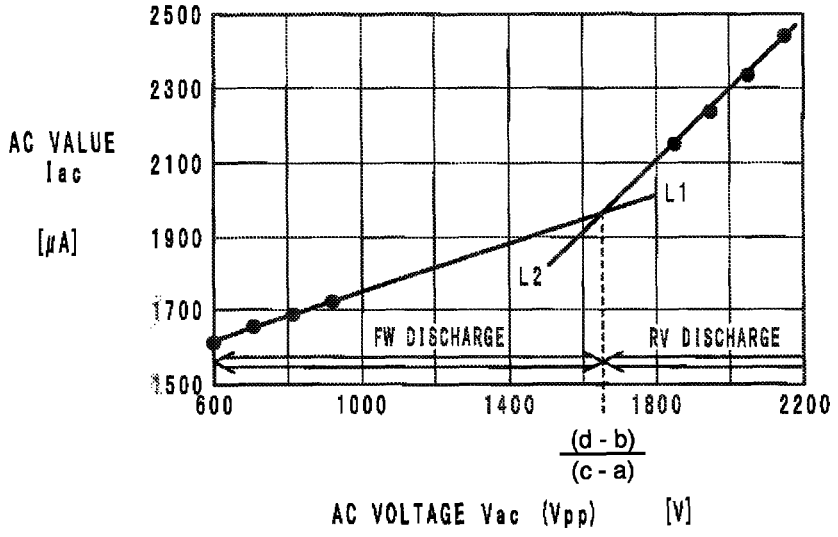
FIG. 6 is a graph indicating a process at S38 in FIG. 5.

With reference to FIGS. 5 and 6, the first charging voltage determination process is described. First, at S31, the CPU 112 selects four sets of (Vpp, Iac) for the forward discharge range, and the CPU 112 linearly approximates a characteristic line L1 indicating the AC value Iac with respect to applied AC voltage Vpp (Iac=a×Vac+b) for the forward discharge range from the four sets of data by the least-square method (see FIG. 6).

Next, at S32, the CPU 112 selects four sets of (Vpp, Iac) for the reverse discharge range, and the CPU 112 linearly approximates a characteristic line L2 indicating the AC value Iac with respect to applied AC voltage Vpp (Iac=c×Vac+d) for the reverse discharge range from the four sets of data in a similar way (see FIG. 6). The values a, b, c and d are constants. Specifically, the values a and c are slopes, and the values b and d are intercepts. The values a and b are derived by using the following expressions (1) and (2). The values c and d are also derived by using similar expressions.

$$a = \frac{4 \cdot \sum_{j=1}^{4} V_{ppj} \cdot I_{acj} - \sum_{j=1}^{4} V_{ppi} \cdot \sum_{j=1}^{4} I_{acj}}{4 \cdot \sum_{j=1}^{4} V_{ppi}^2 - \left(\sum_{j=1}^{4} V_{ppi}\right)^2} \quad (1)$$

-continued $$b = \frac{\sum_{j=1}^{4} V_{ppj}^2 \cdot \sum_{j=1}^{4} I_{acj} - \sum_{j=1}^{4} V_{ppj} I_{acj} \cdot \sum_{j=1}^{4} V_{ppj}}{4 \cdot \sum_{j=1}^{4} V_{ppj}^2 - \left(\sum_{j=1}^{4} V_{ppj}\right)^2} \quad (2)$$

Next, at S33, the CPU 112 derives a difference ΔS (=c−a) in slope between the characteristic lines L1 and L2, and at S34 and S35, the CPU 112 judges whether or not the difference ΔS is equal to or greater than 0.8 and whether or not the difference ΔS is equal to or less than 0.2. If the CPU 112 makes an affirmative judgement at S34 or S35, the CPU 112 recognizes trouble of the amperometric detector 13 or great variation among the AC values Iac obtained at S29. In this case, therefore, at S36, the CPU 112 does not use the data (Vpp, Iac) in the SRAM 113 and sets the reference peak-to-peak voltage Vpp0 derived and stored in the NVRAM 114 at the previous charging voltage determination process (which will hereinafter be referred to as a previous reference peak-to-peak voltage) as a peak-to-peak voltage Vpp0 determined by the current charging voltage determination process. Further, the CPU 112 may display information to inform the users of occurrence of trouble of the amperometric detector 13 on a display or the like (not indicated in the drawings).

If the CPU 112 makes a negative judgement at S35, the CPU 112 judges at S37 whether or not the difference ΔS obtained at S33 is equal to or greater than 0.5. If the CPU 112 makes a positive judgement at S37, the CPU 112 carries out the first charging voltage determination process as described above to derive the value Vpp (=(d−b)/(c−a)) on the point of intersection between the characteristic lines L1 and L2 obtained at S31 and S32. Then, at S38, the CPU 112 sets the derived value (d−b)/(c−a) as a peak-to-peak voltage Vpp0 determined by the current charging voltage determination process and stores the peak-to-peak voltage Vpp0 in the NVRAM 114 as a previous peak-to-peak voltage Vpp0.

On the other hand, if the CPU 112 makes a negative judgement at S37, the CPU 112 sets a predetermined value (1650V in this embodiment) as a peak-to-peak voltage Vpp0 determined by the current charging voltage determination process and stores the value in the NVRAM 114 as a previous peak-to-peak voltage Vpp0 at S39.

On completion of the step S36, S38 or S39, the CPU 112 finishes the process illustrated in FIG. 5 (that is, finishes the process at S215 in FIG. 4) and proceeds to S216 in FIG. 4. The reference peak-to-peak voltage Vpp0 stored at S215 is a value in accordance with the environment step, and the value Vpp0 is far from an accurate value that suites the current environmental conditions. Therefore, the CPU 112 selects one combination of a slope and an intercept from a correction table T3 preliminarily stored in the NVRAM 114 or the like in accordance with the inside temperature St and the inside humidity Sh obtained at S21. In the correction table T3, a combination of a slope and an intercept is given for each combination of a temperature range and a humidity range, as indicated in Table 6 below. For example, the combination of a slope and an intercept for the conditions of Sh (inside humidity)<20% and 10.5° C.≤St (inside temperature)<12.5° C. is a combination of −0.054 and 269.

TABLE 6

| Relative Humidity Sh < 20% | | | | | | | |
|---|---|---|---|---|---|---|---|
| Temperature St ≤ | | 10.5 | 12.5 | 14.5 | 16.5 | 18.5 | 20.5 |
| < | 10.5 | 12.5 | 14.5 | 16.5 | 18.5 | 20.5 | 22.5 |
| Slope | −0.0054 | −0.0054 | −0.0054 | −0.0054 | −0.0054 | −0.0054 | −0.0054 |
| Intercept | 273 | 269 | 254 | 242 | 232 | 222 | 214 |

| Relative Humidity Sh < 20% | | | | | |
|---|---|---|---|---|---|
| Temperature St ≤ | 22.5 | 24.5 | 26.5 | 28.5 | 30.5 |
| < | 24.5 | 26.5 | 28.5 | 30.5 | |
| Slope | −0.0054 | −0.0054 | −0.0054 | −0.0054 | −0.0054 |
| Intercept | 206 | 199 | 193 | 187 | 181 |

| 20% ≤ Relative Humidity Sh < 50% | | | | | | | |
|---|---|---|---|---|---|---|---|
| Temperature St ≤ | | 10.5 | 12.5 | 14.5 | 16.5 | 18.5 | 20.5 |
| < | 10.5 | 12.5 | 14.5 | 16.5 | 18.5 | 20.5 | 22.5 |
| Slope | −0.0054 | −0.0054 | −0.0054 | −0.0054 | −0.0054 | −0.0054 | −0.0054 |
| Intercept | 255 | 243 | 236 | 227 | 219 | 216 | 209 |

| 20% ≤ Relative Humidity Sh < 50% | | | | | |
|---|---|---|---|---|---|
| Temperature St ≤ | 22.5 | 24.5 | 26.5 | 28.5 | 30.5 |
| < | 24.5 | 26.5 | 28.5 | 30.5 | |
| Slope | −0.0054 | −0.0054 | −0.0054 | −0.0054 | −0.0054 |
| Intercept | 203 | 198 | 193 | 188 | 184 |

| 50% ≤ Relative Humidity Sh < 80% | | | | | | | |
|---|---|---|---|---|---|---|---|
| Temperature St ≤ | | 10.5 | 12.5 | 14.5 | 16.5 | 18.5 | 20.5 |
| < | 10.5 | 12.5 | 14.5 | 16.5 | 18.5 | 20.5 | 22.5 |
| Slope | −0.0054 | −0.0054 | −0.0054 | −0.0054 | −0.0054 | −0.0054 | −0.0054 |
| Intercept | 220 | 215 | 212 | 208 | 205 | 203 | 200 |

| 50% ≤ Relative Humidity Sh < 80% | | | | | |
|---|---|---|---|---|---|
| Temperature St ≤ | 22.5 | 24.5 | 26.5 | 28.5 | 30.5 |
| < | 24.5 | 26.5 | 28.5 | 30.5 | |
| Slope | −0.0054 | −0.0054 | −0.0054 | −0.0054 | −0.0054 |
| Intercept | 198 | 196 | 193 | 192 | 190 |

| Relative Humidity Sh ≥ 80% | | | | | | | |
|---|---|---|---|---|---|---|---|
| Temperature St ≤ | | 10.5 | 12.5 | 14.5 | 16.5 | 18.5 | 20.5 |
| < | 10.5 | 12.5 | 14.5 | 16.5 | 18.5 | 20.5 | 22.5 |
| Slope | −0.0054 | −0.0054 | −0.0054 | −0.0054 | −0.0054 | −0.0054 | −0.0054 |
| Intercept | 220 | 215 | 212 | 208 | 205 | 203 | 200 |

| Relative Humidity Sh ≥ 80% | | | | | |
|---|---|---|---|---|---|
| Temperature St ≤ | 22.5 | 24.5 | 26.5 | 28.5 | 30.5 |
| < | 24.5 | 26.5 | 28.5 | 30.5 | |
| Slope | −0.0054 | −0.0054 | −0.0054 | −0.0054 | −0.0054 |
| Intercept | 198 | 196 | 193 | 192 | 190 |

Next, at S217, the CPU 112 obtains the number of rotations of the photoreceptor drum 5 for yellow from the usage condition information Irot stored in the NVRAM 114. Then, at S218, the CPU 112 derives a correction value as follows.

$$\text{Correction Value} = \text{Slope} \times \text{Number of Rotations} + \text{Intercept} \quad (3)$$

Next, at S219, for each of the colors, the CPU 112 derives an actual peak-to-peak voltage Vpp1 accurately suited for the current environmental conditions (temperature and relative humidity) by adding a correction value to the reference peak-to-peak voltage Vpp0 derived at step S215.

In this way, the CPU 112 derives an actual peak-to-peak voltage Vpp1. Then, the CPU 112 sets the peak-to-peak voltages Vpp of the AC voltages to be output from the AC power circuits 102 and 103 to the value Vpp1 derived at S219, and sets the DC voltages Vdc to be output from the DC power circuits 101 to a predetermined value. Thereby, charging voltages Vg are applied to the respective chargers 6, and the photoreceptor drums 5 are charged (S220).

4. Operation and Effects of the Image Forming Apparatus

As thus far described, according to this embodiment, a reference peak-to-peak voltage (current reference peak-to-peak voltage) Vpp0 to be used in the predetermined four processes and the like is derived in a different way depending on the difference ΔS (=c−a) in slope between the characteristic line L1 in the forward discharge range and the characteristic line L2 in the reverse discharge range, and an actual peak-to-peak voltage Vpp1 is derived from the derived reference peak-to-peak voltage. Table 7 below specifically shows the way of deriving the reference peak-to-peak voltage Vpp0 depending on the deference ΔS.

TABLE 7

| Difference ΔS | Name for Value Range | Reference Peak-to-peak Voltage Vpp |
|---|---|---|
| 0.5 ≤ ΔS < 0.8 | First Value Range | (d-b)/(c-a) |
| 0.2 < ΔS < 0.5 | Second Value Range | Predetermined Value (1650 V) |
| ΔS ≤ 0.2 or ΔS ≥ 0.8 | Third Value Range | Previous Vpp0 Stored in NVRAM 114 |

Figure 7:
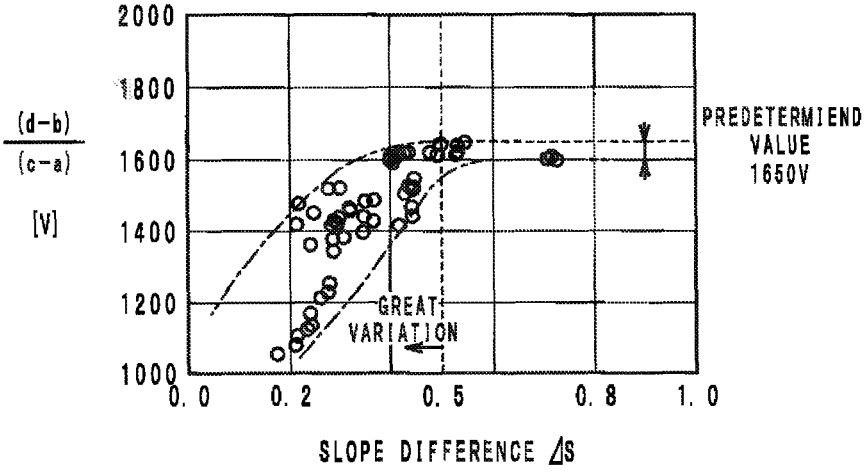
FIG. 7 is a graph showing a technical effect of the image forming apparatus and a reason why the predetermined value at S39 is 1650V.
Figure 8:
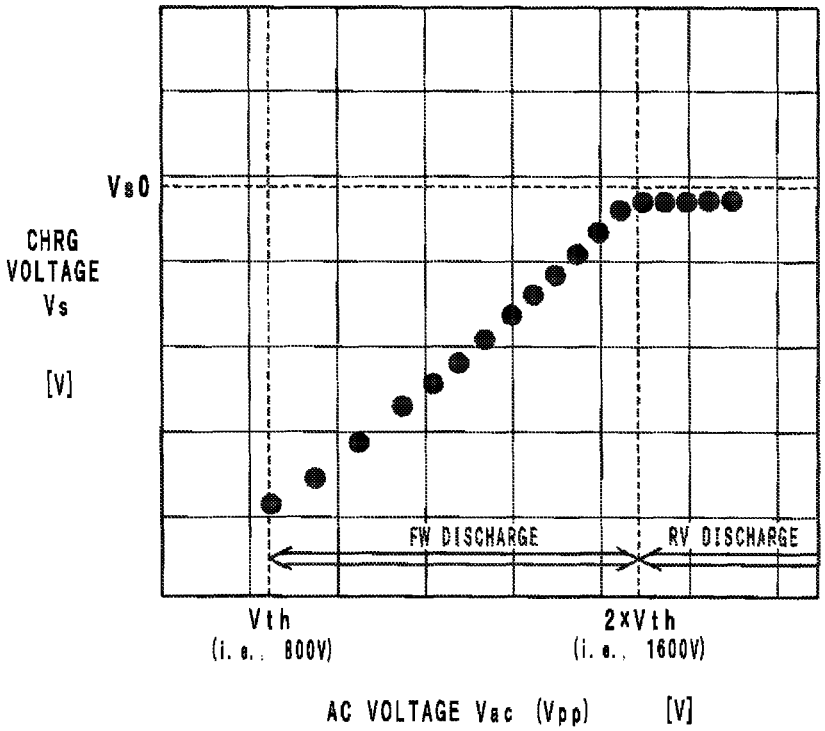
FIG. 8 is a graph indicating a surface potential characteristic of the photoreceptor drum with respect to peak-to-peak voltage.
Figure 9:
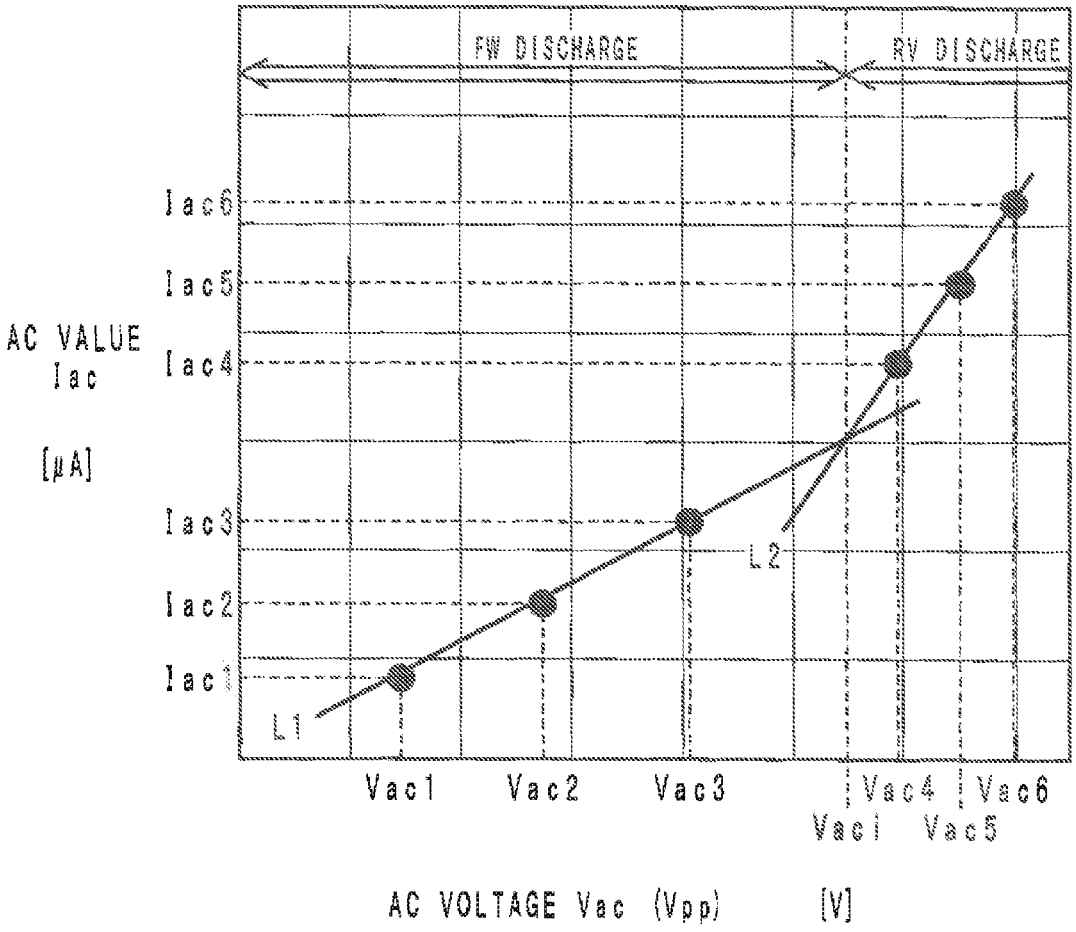
FIG. 9 is a graph indicating a specific example of a first charging voltage determination process.

Next, the reason why the reference peak-to-peak voltage Vpp0 is derived in a different way depending on the difference ΔS is described. FIG. 7 shows a result of an experiment conducted by the inventors and indicates distribution of reference peak-to-peak voltages Vpp0 derived by the first charging voltage process with respect to the difference ΔS. More specifically, FIG. 7 shows a coordinate system of which x-axis indicates difference ΔS and of which y-axis indicates peak-to-peak voltage Vpp (=(d−b)/(c−a)), and in the coordinate system, peak-to-peak voltages Vpp derived from various differences ΔS are plotted on the corresponding points.

As is apparent from FIG. 7, in cases in which the difference ΔS is equal to or greater than 0.5, the value Vpp on the point of intersection between the characteristic lines L1 and L2 is generally close to 1650V. More specifically, in these cases, the value Vpp (=(d−b)/(c−a)) is distributed in a narrow range from about 1600V (lower limit) to about 1650V (upper limit). Thus, in cases in which the difference ΔS is equal to or greater than 0.5 (including cases in which the difference ΔS is in the first value range), it is possible to derive an accurate reference peak-to-peak voltage Vpp0 by the first charging voltage determination process (process at S38 in FIG. 5).

In cases in which the difference ΔS is less than 0.5, the value Vpp on the point of intersection between the characteristic lines L1 and L2 is distributed in a wide range from about 1000V (lower limit) to about 1650V (upper limit). Thus, in cases in which the difference ΔS is lower than 0.5, that is, lower than the lower limit of the first value range (including cases in which the difference ΔS is in the second value range), it is impossible to derive an accurate reference peak-to-peak voltage Vpp0 by the first charging voltage determination process. Therefore, if the difference ΔS is in the second value range, the CPU 112 carries out the process at S39 in FIG. 5 to determine a predetermined value of 1650V (upper limit) as the reference peak-to-peak voltage Vpp0.

The inventors made not only a survey of the peak-to-peak voltage Vpp with respect to the difference ΔS but also a survey of changes in the slopes a and c with respect to the remaining life of the photoreceptor drum 5. As a result, the inventors found out that as the remaining life of the photoreceptor 5 decreases, the slope c increases although the slope a does not change significantly. The reason would be as follows. As the remaining life of the photoreceptor drum 5 decreases, the film of the photoreceptor drum 5 becomes thinner. In such a state, when an AC voltage with a peak-to-peak voltage Vpp for the reverse discharge range is applied to the charger 6, a great current flows, and the AC value Iac output from the amperometric detector 13 would be erroneous. Accordingly, the slope c derived from the AC value Iac would be erroneous. Also, the amperometric detector 13 may exhibit abnormal behavior. If the first charging voltage determination process is carried out in such a state, the value Vpp (=(d−b)/(c−a)) would be higher than a value that would be obtained under normal circumstances. In this case, a charging voltage Vg including an AC voltage Vaci higher than a value that would be obtained under normal circumstances may be applied to the charger 6, and consequently, abrasion of the film of the photoreceptor drum 5 may be accelerated excessively. For this reason, according to this embodiment, even if the difference ΔS is equal to or greater than 0.5, if the difference ΔS is equal to or greater than 0.8 (that is, equal to or greater than the upper limit of the first value range), the CPU 112 does not carry out the first charging voltage determination process, and the previous reference peak-to-peak voltage Vpp0 is used in the current charging voltage determination process (S36 in FIG. 5).

Also, the inventors found out that when the film of the photoreceptor 5 is as thick as that of a brand-new photoreceptor or when the ambient temperature is low, the slope c decreases although the slope a does not change significantly. If the first charging voltage determination process is carried out in such a state, the value Vpp (=(d−b)/(c−a)) would be lower than a value that would be obtained under normal circumstances, and the lower Vpp may cause toner fogging. For this reason, according to this embodiment, even if the difference ΔS is less than 0.5, if the difference ΔS is equal to or less than 0.2 (that is, equal to or less than the lower limit of the second value range), the CPU 112 determines the reference peak-to-peak value neither by carrying out the first charging voltage determination process (S38) nor by using the predetermined value (S39), and the previous reference peak-to-peak voltage Vpp0 is used in the current charging voltage determination process (S36 in FIG. 5).

As thus far described, the image forming apparatus 1 selects one of the three ways of determining a charging voltage (S36, S38 and S39) depending on the difference ΔS, which changes in accordance with the ambient temperature and the photoreceptor film thickness, and derives a peak-to-peak voltage in the selected way. Accordingly, the image forming apparatus 1 can derive an appropriate peak-to-peak voltage Vpp regardless of the ambient temperature and the photoreceptor film thickness.

5. Supplemental Remarks

According to the description above, the amperometric detector 13 is provided at the charger 6 for yellow. However, as long as the power source 10 includes AC power circuits 102 and 103, the amperometric detector 13 may be provided at any one of the chargers 6.

Also, the image forming apparatus 1 may have two amperometric detectors 13. In this case, one of the amperometric detectors 13 may be provided at any one of the chargers 6 for yellow, magenta and cyan, and the other amperometric detector 13 may be provided at the charger 6 for black. In this case, the CPU 112 may derive a peak-to-peak voltage Vpp of an AC voltage to be output from the AC power circuit 102 for yellow, magenta and cyan and derive a peak-to-peak voltage Vpp of an AC voltage to be output from the AC power circuit 103 for black.

According to the description above, the power source 10 includes an AC power circuit 102 for yellow, magenta and cyan, and an AC power circuit 103 for black. However, the power source 10 may include AC power circuits used for yellow, magenta, cyan and black, respectively. In this case, the image forming apparatus 1 may have four amperometric detectors 13, and the CPU 112 may derive peak-to-peak voltages Vpp of AC voltages to be output from the respective AC power circuits.

As indicated by S216-S218 in FIG. 4, the CPU 112 derives a correction value depending on the current environmental conditions (inside temperature St and insider humidity Sh) and the usage condition (the number of rotations) of the photoreceptor drum 5. However, if the environmental condition detector 12 includes a absolute humidity sensor, the CPU 112 may select a combination of a slope and an intercept from the correction table T3 (see Table 6) depending on the absolute humidity to derive a correction value. Also, the correction table T3 may be prepared based on either the temperature or the relative humidity.

Although the present invention has been described in connection with the preferred embodiment above, it is to be noted that various changes and modifications may be obvious to those who are skilled in the art. Such changes and modifications are to be understood as being within the scope of the invention.

What is claimed is:

1. An image forming apparatus capable of forming an image on a print medium while feeding the print medium, the image forming apparatus comprising:

an image supporting member;

a charger provided in proximity to the image supporting member;

a power source configured to apply a plurality of charging voltages to the charger sequentially while no print medium is fed, the plurality of alternating voltages having different peak-to-peak voltages for a forward discharge range, in which charge transfer from the charger to the image supporting member occurs, and different peak-to-peak voltages for a reverse discharge range, in which charge transfer from the image supporting member to the charger occurs, respectively;

an amperometric detector configured to detect values of alternating current flowing in the charger during application of the plurality of charging voltages; and a processor configured to derive a characteristic line of alternating current value with respect to alternating voltage for the forward discharge range and a characteristic line of alternating current value with respect to alternating voltage for the reverse discharge range from the values of alternating current detected by the amperometric detector, wherein the processor derives a peak-to-peak voltage to be used in an image forming process depending on different ranges of a difference in slope between the characteristic line for the forward discharge range and the characteristic line for the reverse discharge range, and wherein the processor derives the peak-to-peak voltage to be used in the image forming process based on a point of intersection between the characteristic line for the forward discharge range and the characteristic line for the reverse discharge range in a case in which the difference is in a first value range.

2. The image forming apparatus according to claim 1, wherein the processor determines a predetermined value as the peak-to-peak voltage to be used in the image forming process in a case in which the difference is in a second value range lower than a lower limit of the first value range.

3. The image forming apparatus according to claim 2, wherein:

a distribution of the peak-to-peak voltages corresponding to the respective points of intersection with respect to the difference is preliminarily prepared; and the predetermined value is obtained from the distribution and is an upper limit of the point of intersection when the difference is in the second value range.

4. The image forming apparatus according to claim 1, wherein the processor corrects the derived peak-to-peak voltage according to a current environmental condition and a usage condition of the image supporting member.

5. The image forming apparatus according to claim 4, wherein the environmental condition includes at least one of a temperature, a relative humidity and an absolute humidity.

6. The image forming apparatus according to claim 1, wherein:

a second value range is set to be lower than a lower limit of the first value range; and in a case in which the difference is equal to or lower than a lower limit of the second value range, the processor judges that a detection result of the amperometric detector is an error.

7. The image forming apparatus according to claim 1, wherein:

in a case in which the difference is equal to or greater than an upper limit of the first value range, the processor judges that a detection result of the amperometric detector is an error.

* * * * *